United States Patent [19]

Glymph

[11] 4,294,267

[45] Oct. 13, 1981

[54] POCKET PIPE

[76] Inventor: Ronald C. Glymph, 11914 Wilmington Ave., Los Angeles, Calif. 90059

[21] Appl. No.: 810,636

[22] Filed: Jun. 27, 1977

[51] Int. Cl.[3] ..... A24F 3/02; A24F 7/00; A24F 5/10; A24F 5/12

[52] U.S. Cl. ..... 131/330; 131/179; 131/180; 131/223; 131/226; 131/227; D27/3

[58] Field of Search ..... 131/171 R, 179, 194, 131/180, 195, 216, 221, 184 A, 222, 226, 176, 178, 198 R, 198 A, 223, 227; D27/3

[56] References Cited

U.S. PATENT DOCUMENTS

| | | | |
|---|---|---|---|
| 115,363 | 5/1871 | Ruge | 131/222 |
| 906,328 | 12/1908 | Stevens | 131/180 |
| 1,021,963 | 4/1912 | Ansley | 131/180 |
| 2,035,783 | 3/1936 | Bernard | 131/180 |
| 4,165,753 | 8/1979 | Stryker | 131/194 |

FOREIGN PATENT DOCUMENTS

| | | | |
|---|---|---|---|
| 21884 | of 1911 | United Kingdom | 131/177 |

*Primary Examiner*—V. Millin
*Attorney, Agent, or Firm*—Edward E. Roberts

[57] ABSTRACT

An integral smoking pipe is provided. The pipe includes a burning chamber or bowl, a tobacco storage chamber and a resin collecting chamber or clean-out area. The resin collecting chamber and the burning chamber communicate through one or more common apertures. The smoking aperture or mouth piece communicates with the burning chamber via the resin collecting chamber. Suitable caps or stoppers are provided for each of the chambers. The caps in at least one of the chambers, e.g. the burning chamber, may include a tine for cleaning the apertures between the burning chamber and the resin collecting chamber.

4 Claims, 4 Drawing Figures

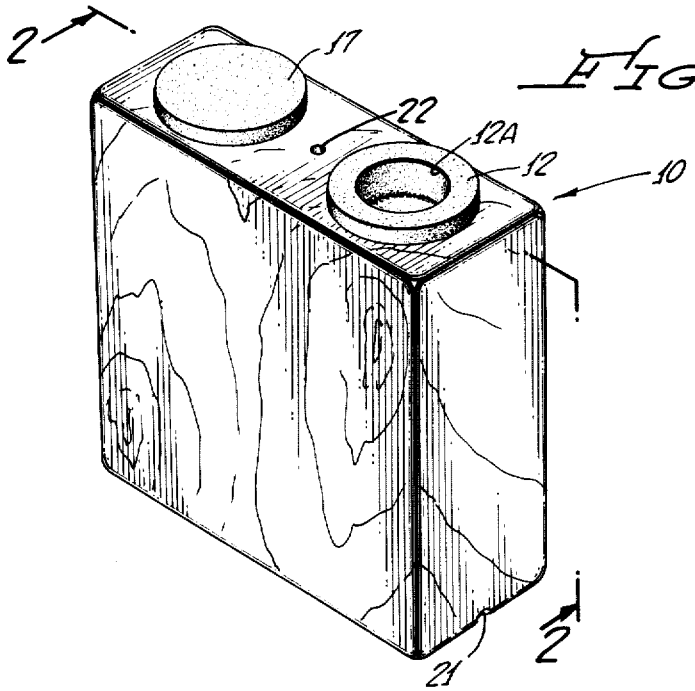
FIG. 1.
FIG. 2.
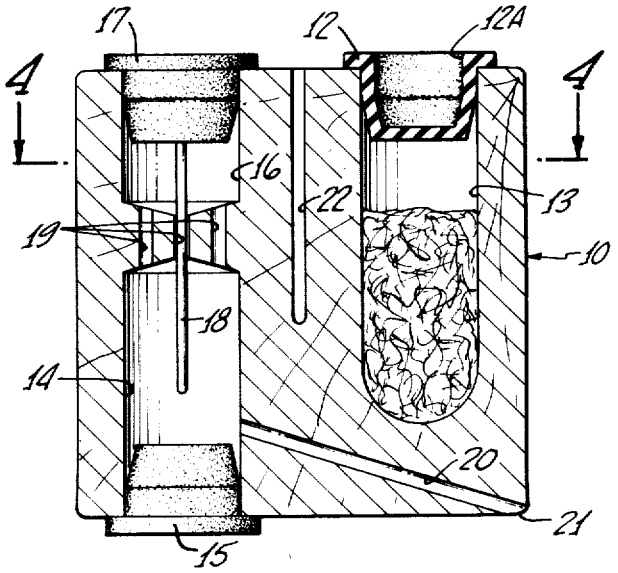
FIG. 3.
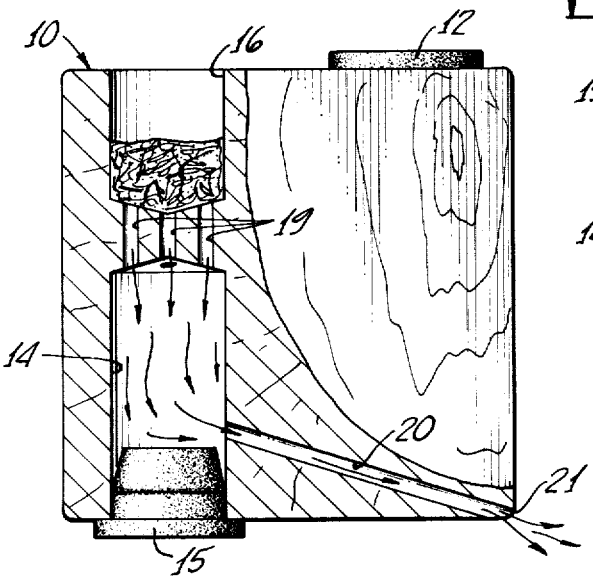
FIG. 4.
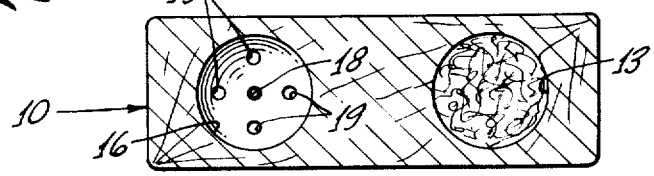

POCKET PIPE

BACKGROUND

1. Field of the Invention

This invention relates to tobacco smoking pipes in general, and to a fully integrated, pocket sized smoking pipe, in particular.

2. Prior Art

There are many known tobacco smoking pipes available in the prior art. Such tobacco smoking pipes have been known for centuries. Modification to the known pipes are nearly as old. However, most pipes known in the art are generally quite bulky and space demanding. The problems encountered by most pipe smokers is a direct function of the inconvenience associated therewith in terms of carrying tobacco pouches, carrying a bulky pipe, carrying bulky pipe cleaning equipment and the like. Beyond the ordinary smoking pipe of whatever variety, known in the art, the most pertinent references discovered by applicant are U.S. Pat. Nos. 682,678, Roller; 906,328, Stevens; 1,050,005, Austin; 2,662,530, Lockard; 2,391,548, Comptois; and 2,388,338, Mueller. Each of the cited patents is directed to a tobacco smoking pipe having unique characteristics. However, none of the cited references teach the unique integral pipe described hereinafter.

SUMMARY OF THE INVENTION

There is described a unique integral pipe structure especially adapted for minaturized smoking pipe apparatus. In a single body of suitable material, chambers are provided for tobacco storage, tobacco burning, and resin collecting. The latter two chambers communicate through common apertures. A "stem" is provided in the pipe body and communicates with the resin collecting chamber. Suitable caps or stoppers are provided to close any of the chambers. An integral cap/tool for cleaning the common apertures is provided.

BRIEF DESCRIPTION OF THE DRAWINGS

FIG. 1 is a perspective view of the instant invention.

FIG. 2 is a cross-sectional view of the instant invention, taken along lines 2—2 of FIG. 1.

FIG. 3 is a partially broken away view of FIG. 1.

FIG. 4 is a top view of the instant invention taken along the lines 4—4 of FIG. 2.

BRIEF DESCRIPTION OF THE PREFERRED EMBODIMENT

Referring concurrently to FIGS. 1 to 4, there is shown the smoking pipe of the instant invention. The pipe comprises a unitary body 10 which may be fabricated of a suitable wood or other material. Typically, body 10 of the pipe is approximately 2 inches by 2 inches by ¾ of an inch. This size configuration permits the pipe to be readily stored in any pocket or the like of the user.

A first chamber 13 is provided in body 10. Chamber 13 is the "stash" or storage chamber for storing tobacco or other smoking materials. Chamber 13 is shown passing substantially through the entire length of the body 10 wherein a relatively large storage chamber is provided. Typically, chamber 13 has a diameter of approximately ½ inch and extends through the body a dimension equal in approximately 1½ inches to the embodiment disclosed.

Cap 12 is provided for chamber 13. Cap 12 has a portion which engages with the outer edge of chamber 13 to form a snug fit. In addition, cap 12 includes a hollow portion 12A which is used for transferring smoking materials as described hereinafter.

Second chamber 16 is provided in body 10. This chamber is the smoking or burning chamber which is comparable to the "bowl" in any other smoking pipe. Chamber 16 has a diameter of approximately ½ inch and extends approximately ½ inch into body 10. Cap 17 is provided to fit snugly into chamber 16 to keep this chamber closed when not in use. In addition, cap 17 has an elongated dependent tine or wire which depends therefrom. Tine 18, in the position shown, extends through one of the apertures 19 in the base of chamber 16. Cap 17 and tine 18 form an integral tool which is used for cleaning apertures 19 after use of the pipe in order to promote cleanliness and improved operation thereof.

Chamber 14 extends into body 10 from the reverse or bottom side thereof. Chamber 14 also has a diameter of approximately ½ inch and extends into body 10 approximately one inch. Cap 15 is provided to establish a snug, close fit to substantially seal chamber 14 in an air tight manner. Chambers 14 and 16 communicate via the plurality of apertures 19 provided in the intervening portion of body 10.

An elongated aperture of channel 20 extends from a corner or body 10 into communication with chamber 14. The outer end of the channel 20 forms mouthpiece 21.

An optional aperture 22 shown in FIG. 2 can be provided to act as a receptacle for tine 18 (dependent from cap 17) while the pipe is in use. Of course, this receptacle is not required.

In using the pipe, it is assumed that tobacco or other smoking materials are stored in stash chamber 13. Cap 12 is removed from Chamber 13 and inverted thereover. Thus, the hollow portion 12A of cap 12 is aligned with chamber 13. The entire apparatus is then inverted, wherein smoking materials are deposited in hollow 12A. The "loaded" cap 12 is then placed over chamber 16 after cap 17 has been removed. The load or stash of smoking materials is thereby deposited in chamber 16. Cap 12 is then replaced in chamber 13 and cap 17 is either stored at aperture 22 or elsewhere by the user. By applying a flame at the open end of chamber 16 and drawing at mouthpiece 21, the stash of smoking materials is lighted in a typical manner. The user then continues to smoke using mouthpiece 21 and channel 20 to draw via chamber 14 on the burning smoking materials in chamber 16. The smoke thus travels from open chamber 16 to mouthpiece 21 via apertures 19, closed chamber 14 and aperture 20 as shown best in FIG. 3.

When the load or stash has been consumed, cap 17 and tine 18 are used to clean apertures 19 in chamber 16 by pushing the material through apertures 19 into chamber 14. (of course, any loose residue can be dumped out of the open end of chamber 16.) After this operation, cap 15 is removed and the debris in chamber 14 is removed. Of course, cap 15 can be removed first and debris from chamber 14 removed immediately. Other obvious cleaning sequences can also be used.

Thus, there has been shown and described a unique smoking pipe which lends itself to ease of handling and operation. This description is intended to be illustrative only and not to be limitative. For example the dimensions which have been given are suggestive only and are not requirements. The dimensions may be modified to suit the user or manufacturer. The materials of the body 10 as well as the caps 12, 15 and 17 can be modified as desired. Thus, any modifications which suggest themselves to those skilled in the art are intended to be included within the purview of this description as well.

Having thus described a perferred embodiment of the invention, what is claimed is:

1. A smoking pipe comprising:

a unitary body;

first and second chambers in said body each communicating with an exterior surface of said body with an intervening portion of said body between said first and second chambers, said first chamber adapted to receive burning materials for smoking and said second chamber adapted to receive smoke and resin from said first chamber;

at least one aperture in said intervening portion communicating with each of said first and second chambers;

a channel in said body communicating with said second chamber and the exterior of said body to form a mouthpiece for said pipe;

a third chamber in said body communicating with an exterior surface of said body and separated from said first and second chambers, said third chamber providing means for storage of smoking materials;

removable caps for each of said chambers, at least one of said caps having a tine dependent therefrom for cleaning said aperture in said intervening portion;

said caps having a portion which engages the outer edge of its respective chamber to form a snug fit and a main body which extends from said snugly fitted portion into its chamber when its outer portion is in a snugly fitted relationship; and at least one of said main bodies of said caps having a hollow portion therein for transferring smoking materials.

2. The smoking pipe of claim 1 wherein;

said first chamber, said third chamber and said storage means communicate with a first exterior surface of said body, and said second chamber communicates with a second exterior surface of said body.

3. The smoking pipe of claim 2 wherein, said channel exits said body at substantially the center of the intersection of said second exterior surface and a third exterior surface of said body, and said body is substantially rectangular having substantially uniform thickness.

4. The smoking pipe recited in claim 1 including storage means in said body communicating with an exterior surface thereof for receiving said tine for storage thereof.

* * * * *